United States Patent [19]

Maziuk

[11] 4,010,093

[45] Mar. 1, 1977

[54] METHOD OF OPERATING A PLATINUM REFORMER COMPRISING A SELECTIVE ZEOLITE CATALYST IN THIRD REACTOR

[75] Inventor: John Maziuk, Yardley, Pa.

[73] Assignee: Mobil Oil Corporation, New York, N.Y.

[22] Filed: Feb. 4, 1975

[21] Appl. No.: 547,070

Related U.S. Application Data

[63] Continuation of Ser. No. 338,465, March 6, 1973, abandoned.

[52] U.S. Cl. ..... 208/65; 208/66

[51] Int. Cl.[2] ..... C10G 39/00

[58] Field of Search ..... 208/65, 66

[56] References Cited

UNITED STATES PATENTS

| | | | |
|---|---|---|---|
| 3,287,253 | 11/1966 | McHenry et al. | 208/65 |
| 3,395,094 | 7/1968 | Weisz | 208/65 |
| 3,516,924 | 6/1970 | Forbes | 208/65 |
| 3,528,908 | 9/1970 | Bowles et al. | 208/57 |
| 3,729,409 | 4/1973 | Chen | 208/65 |
| 3,804,748 | 4/1974 | Nelson et al. | 208/211 |
| 3,849,290 | 11/1974 | Wise et al. | 208/66 |

*Primary Examiner*—Herbert Levine
*Attorney, Agent, or Firm*—C. A. Huggett; M. G. Gilman; C. D. Farnsworth

[57] ABSTRACT

A reforming operation is described which incorporates a zeolite selective conversion catalyst as a final catalyst composition contacted under temperature conditions controlled by quench gas as a function of product and seasonal demands. Preferably the zeolite catalyst is included as a separate downstream bed of catalyst in an enlarged final reactor of a three reactor reforming operation.

9 Claims, 1 Drawing Figure

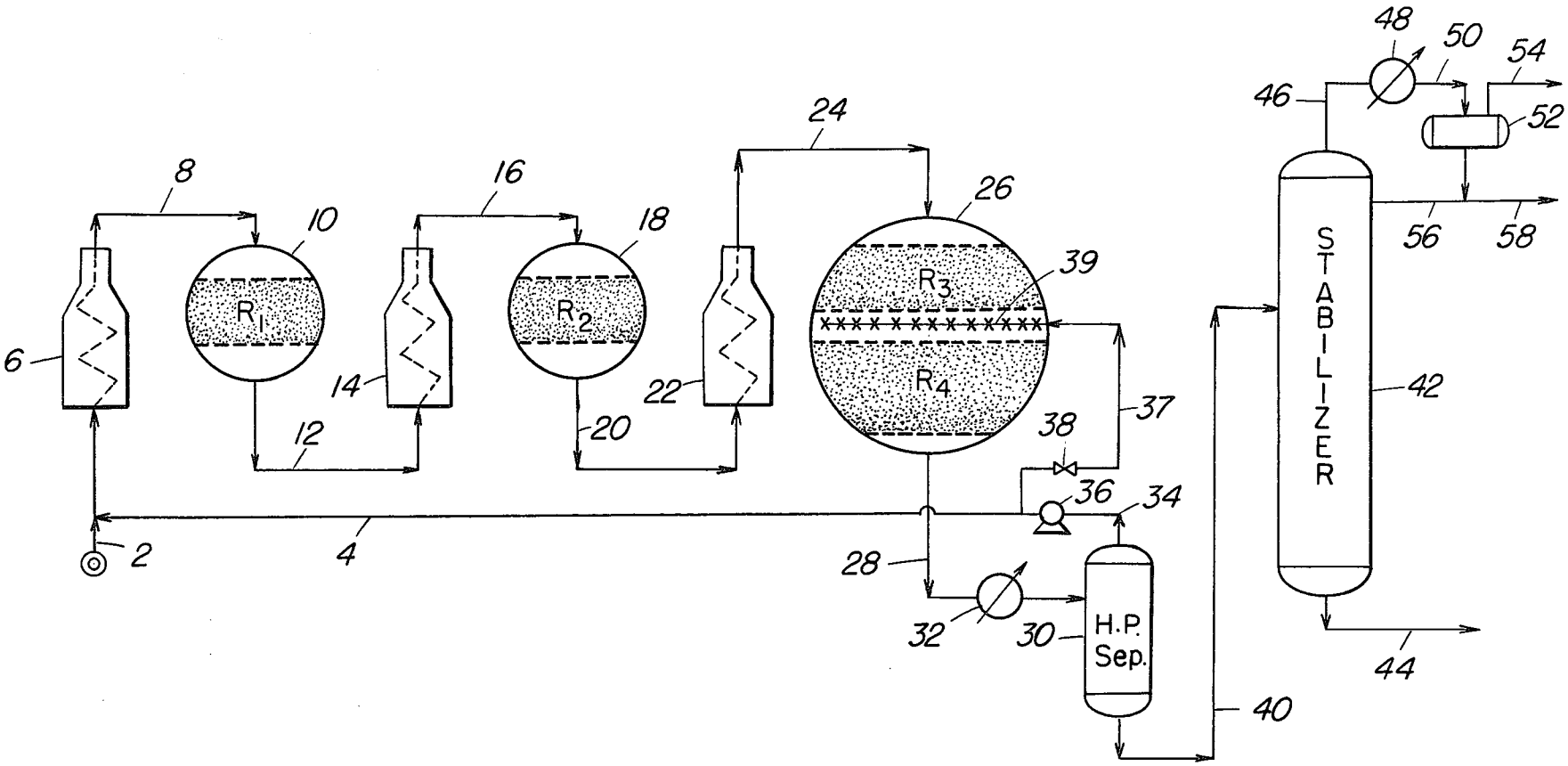
STABILIZER
H.P. Sep.
R1
R2
R3
R4
2
4
6
8
10
12
14
16
18
20
22
24
26
28
30
32
34
36
37
38
39
40
42
44
46
48
50
52
54
56
58

METHOD OF OPERATING A PLATINUM REFORMER COMPRISING A SELECTIVE ZEOLITE CATALYST IN THIRD REACTOR

This application is a continuation of application Ser. No. 338,465, filed Mar. 6, 1973 now abandoned.

BACKGROUND OF THE INVENTION

Reforming is well known and performs a major function is the present-day petroleum refinery industry. It represents a convenient method for upgrading gasoline boiling range hydrocarbons having a relatively low octane number to aromatic enriched product having an octane rating in excess of 100. It is thus of economic importance and considerable energy has been expended to improve upon the reforming operation so that less critical charge material can be upgraded to a desired product with a minimum loss in volume of product available from the charge material. It is well recognized that in reforming a number of reactions occur and that each reaction can be particularly favored by adjustment of reaction conditions in cooperation with a particular composition. In naphtha reforming operations endothermic reactions predominate in the first stages of reforming while exothermic reactions increase and may even predominate in the later stages of the reforming operation. Furthermore, specific operating conditions are selected for use in conjunction with the particular catalyst and hydrocarbon charge employed. To take advantage of the reactions and reaction sequence in catalytic reforming it has been the practice to employ in combination a plurality of fixed bed reactors arranged in series with provision for adjusting the temperature essential by reheating of the hydrocarbon reactant between reactors. Generally, for a matter of economic convenience the pressure employed in each reactor is decreased in the direction of hydrocarbon flow sequentially through the plurality of reactors to avoid use of expensive compressors between the separate reactors. Thus the pressure drop will not be substantially more than that encountered by the reactants passing through the reactors, catalyst beds, heaters and inter-connecting piping to provide the desired flow of reactants therethrough. In addition the vapor inlet temperature selected for each reactor is dependent upon the charge stock composition, the hydrogen to hydrocarbon ratio employed, the reactant space velocity, the type and distribution of catalyst in the plurality of the reactors, the degree of conversion desired and product selectivity desired from the reactors. Catalytic reforming of hydrocarbons generally comprises four major reactions which can be adjusted in magnitude by reaction conditions and catalyst employed. The predominant reaction in the first stage of reforming is known to be dehydrogenation to convert naphthenes to aromatics. Another reaction essential in this stage is the isomerization of cyclopentanes to cyclohexanes. Other reactions which occur and are controllable to some extent are the cracking of naphthenes and paraffins and the isomerization of paraffins. The major reforming reaction which may occur in a subsequent stage is dehydrocyclization of straight chain paraffins to aromatics thereby further increasing the octane rating of the product material. In dehydrocyclization reactions, the paraffins are cyclized and dehydrogenated to form aromatics. To maximize product volume from a given charge material a closely controlled operation to optimize both platinum type hydrogenation-dehydrogenation and acidic catalyst functions is required. A third reaction of importance in reforming is concerned with the isomerization of paraffins, olefins, and naphthenes. The isomerization of paraffins, not cyclized results in significant octane improvement and requires an acid function. It is well known, however, that acid functions contribute to cracking and therefore hydrocracking of constituents in the hydrocarbon charge must be selectively controlled to avoid producing undesired gaseous components and carbonaceous material formation in the reforming operation. In the prior art practice of reforming naphthene charge material in the gasoline boiling range it has been found desirable to maintain a selective balance in the acidic and hydrogenation-dehydrogenation functions of the reforming catalyst so that the selectivity of the reforming operation can be related to the charge stock composition, operating conditions and reformate product desired.

In practice reforming catalysts of the prior art have particularly includes a platinum group metal selected from within relatively narrow limits of from about 0.15 percent to about 1.0 percent by weight of the catalyst. At these concentrations the active platinum sites may be spread throughout the support matrix and the activity level of the hydrogenation-dehydrogenation function can be controlled substantially as desired. In addition the catalyst acid function has been limited to maintain a desired balance with the hydrogenation-dehydrogenation function of the catalyst. Platinum type reforming catalysts have been modified by a great number of activating agents or promoters as a basis for improvement upon the selectivity of the reforming operation. However, because of inherent difficulties in operation and problems associated with improving upon catalyst life between regenerations, the industry will continue to search for methods for improving upon the already known reforming operation.

SUMMARY OF THE INVENTION

The present invention is concerned with a multireactor catalytic reforming operation such as a three reactor reforming operation wherein the third reactor is arranged to house two separate catalyst beds differing in composition providing activity and selectivity parameters responding to changes in operating temperatures to provide products differing substantially in composition. In this arrangement a platinum reforming catalyst and a crystalline zeolite catalyst composition providing selectivity for converting particularly n-paraffins is used and controlled as a function of temperature. In a more particular aspect the present invention is concerned with the method of operating a processing combination comprising a platinum catalyst-naphtha reforming operation in which a very selective crystalline aluminosilicate (CAS) type catalyst is retained in a third reactor stage so that the yields of gasoline boiling range reformate product can be maximized particularly during summer season operation of the process but considerably reduced in favor of aromatic concentrates and LPG type gaseous product during other demand periods such as winter season operation. Thus it has been found during experimental evaluation of relatively small pore size crystalline aluminosilicates such as nickel-erionite and crystalline materials of the ZSM-5 type that their activity and selectivity with respect to product produced is greatly influenced by temperature and $H_2$ to hydrocarbon ratio conditions.

Furthermore, these operating parameters can be controlled to enhance the catalysts life and influence the product yields of the naphtha reforming operation to products more suitable for summer and winter demands. Thus by applying the principles herein identified, small pore crystalline zeolite type catalyst composition providing conversion selectivity particularly for n-paraffins may be used in combination with a platinum reforming catayst in the third reactor of a sequence of reforming reactors to optimize the product yield obtained therefrom substantially as desired through the expedient of controlling particularly the temperature of the crystalline zeolite component of the catalyst system. Thus by using a hydrogen rich gas such as hydrogen containing recycle gas of the reforming operation quench or cool the temperature of the crystalline zeolite catalyst composition to a relatively low temperature and preferably less than 600° F., the yields of reformate product comprising gasoline boiling range material may be substantially maximized. On the other hand, when selectivity for liquid propane gas (LPG) type products are in particular demand, by the simple expedient of raising the temperature of the zeolite catalyst components above about 600° F. and preferably in the range of 650 to 850° F., the LPG gas production is considerably improved and the activity of the respective catalyst components of the third reactor is kept in balance with a cycle life commensurate with a reforming operation requiring infrequent regeneration of the catalyst.

The operating concepts of the present invention reap further significant advantage through adjustment of the hydrogen to hydrocarbon ratio during the operating sequence contemplated. That is, when the volumes of recycle hydrogen rich gas are large to maintain the crystalline zeolite catalyst at a desired low and substantially inactive temperature, the hydrogen requirements available during reforming are lower providing a low hydrogen partial pressure promoting dehydrogenation and thus maximize the yields of reformate gasoline; thus bringing the entire operation substantially in balance with respect to the hydrogen requirments thereof. On the other hand, when the production of LPG gases are particularly desired, cooling of the crystalline zeolite component is not required and the hydrogen rich recycle gas passed to reforming may be increased so that a hydrogen partial pressure promoting hydrocracking during reforming will be available thus contributing to the production of reformate components easily converted by the zeolite catalyst to LPG gases.

The method and combination of processing steps of this invention in conjunction with selected reaction conditions and particular catalyst compositions contribute to effecting the selective conversion of available hydrocarbon components comprising ring, normal and branched hydrocarbon components in a hydrogen atmosphere to gasoline and/or LPG products.

The operating conditions generally employed in the processing embodiment of this invention are selected so that a platinum type reforming catalyst known in the prior art and particularly the more recently developed bimetal or mult-metallic reforming catalysts will be exposed to temperature selected from within the range of about 800° F. up to about 1000° F., preferably from 850 up to about 980° F., using a liqiud hourly space velocity in the range of from about 0.1 up to about 10, preferably from 0.5 to about 5 and a pressure selected from within the range of about atmospheric pressure up to about 700 psig but preferably in the range of 50 psig up to about 400 psig. Generally lower operating pressures are preferred for maximum gasoline yield. A hydrogen to hydrocarbon ratio selected from within the range of 0.5 to about 10 has been found satisfactory and will be varied considerably as hereinbefore indicated.

A selective conversion of reformate product obtained within the above defined operating conditions is contemplated when it is particularly desired to produce LPG products. That is, in the processing combination of this invention, the total reformate product is caused to pass in contact with a second catalyst composition comprising a crystalline zeolite of restricted pore size and having activity and selectivity particularly for converting paraffins controlled by temperature conditions to obtain gasoline boiling range material, aromatic enriched product and LPG type material. The catalyst relied upon for a final contact with reformate material is referred to herein as a relatively small pore crystalline zeolite providing a maximum pore opening not substantially larger than about 9 Angstroms and excluding hydrocarbon components generally larger than single branched hydrocarbons. Crystalline zeolite type catalyst identifiable with the above restriction and contemplated for use herein are described in U.S. Pat. No. 3,702,886 issued Nov. 14, 1972, U.S. Pat. No. 3,395,094 issued July 30, 1968 and the description of such catalysts is intended to be included herein by reference as a part of this disclosure.

In accordance with the operating concepts this invention the reformate product of a platinum type catalyst reforming operation is caused to pass through a bed of the selective zeolite type catalyst maintained at a temperature above about 650° F. when the production of LPG is particularly desired but below about 650° and more usually not above about 600° F. when the production of gasoline boiling material is particularly desired. Thus the operating concepts of this invention contemplate including a zeolite catalyst of the ZSM-5 type or a smaller pore size material of the erionite type provided with hydrogenation activity as the most downstream catalyst bed which is housed in a downstream portion of the final reactor of the sequence of reforming reactors. In this arrangement, provisions are made for injecting a quench gas such as cold hydrogen rich recycle gas between catalyst beds in the final reactor comprising the platinum reforming catalyst bed and the zeolite type catalyst bed above identified. On the other hand, the zeolite type catalyst may be housed in a separate downstream reactor. However, in the interest of economy, it is generally preferred to house the zeolite type catalyst in the third reactor and downstream of the platinum reforming catalyst retained therein. In this latter arrangement, means are provided for distributing quench gas between catalyst beds to quench the reformate product of platinum reforming before it makes contact with the selective crystalline aluminosilicate catalyst. When LPG is particularly desired as a product of the process the reformate product is passed through the crystalline zeolite catalyst at a temperature within the range of 650 to about 850° F In pursuing the operating concepts of this invention, it has been found that a cold hydrogen rich quench gas serves the multifunction purpose of cooling reformate when desired in addition to reducing the aging rate of the crystalline zeolite catalyst to an interval commensurate with the aging rate of the platinum reforming catalyst. Furthermore it has been found that in an operating cycle requiring a relatively large amount of hydrogen quench gas that the remaining smaller amount of hydrogen recycle gas available for recycle to the reforming operation promotes dehydrogenation reactions and the formation of constituents more selectively converted by the zeolite catalyst to LPG product at selected temperature conditions. Furthermore, the combination of high hydrogen to hydrocarbon ratio and relatively high temperatures (650° to 850° F) operates to promote the production of propane (LPG). Generally the mass of zeolite catalyst such as ZSM-5 type or an erionite type retained in the third or final reactor will be less than, equal to, or even greater than the volume of platinum reforming catalyst retained therein. During conversion of n-paraffins and/or singly branched hydrocarbons to LPG material by the crystalline zeolite catalyst component the temperature will be maintained within the range of 650° F. up to about 850° F., the (LHSV) liquid hourly space velocity will be in the range of 1 to 10 and the ratio of hydrogen to hydrocarbons will be sufficient to promote the formation of saturated LPG products.

In accordance with an aspect of this invention an inter-bed reactor quench system has been provided. The inter-bed quench system is suited ideally for a multi-bed catalyst system contained in a reactor where it is desired to control catalyst selectivities by temperature management in order to optimize a balance or control of the two catalysts. In a basic multi-reactor reforming operation it is not unusual for a third reactor in the sequence of reactors to be about twice the size of the first or second reactors in the reforming sequence. Furthermore, the catalyst retained in the third reactor may be as a single bed of catalyst or be divided into two or more beds.

The development of highly selective conversion catalysts from particular crystalline aluminosilicates such as above identified opens the door so to speak, for significantly improving the prior art multi-reactor reforming operation. Thus one mechanism for using these selective conversion catalysts is to replace some of the existing platinum reforming catalysts with the crystalline zeolite selective conversion catalysts. In a system such as that shown in the attached figure wherein equal volumes of a platinum type catalyst is retained in each reactor and the lower half of the third reactor contains a selective zeolite conversion catalyst; this reduces the amount of platinum catalyst available in the operation but it provides a more selective dual bed catalyst system for increasing propane yields and raising front end octane number of the reformate product. Such a system without quench provisions between catalyst beds however has two distinct disadvantages.

1. A selective catalyst such as a ZSM-5 type material which is highly selective at operating temperatures of 700°–800° F. is forced to operate at reforming catalyst temperatures in the range of 850°–980° F. and higher. Thus the ZSM-5 type catalyst selectivity for LPG product cannot be optimum.

2. Once the ZSM-5 catalyst is installed as provided above in the absence of quenching facilities there is no way to balance the reactions between the platinum reforming catalyst and the selective conversion catalyst. That is, the system cannot be controlled to maximize propane yields during the winter season and minimize gasoline and then reverse the procedure during the summer months.

In order to operate the selective conversion catalyst at a lower more desirable temperature range two other catalyst systems can be envisioned. In one system the platinum catalyst product effluent can be cooled by heat exchange and a separate fourth reactor can then be provided for housing the selective conversion zeolite catalyst. This system involves adding costly equipment not warranted or possibly for space reasons not desirable and extensive process operating downtime would be encountered to provide the additional facilities for such an operation. In yet another arrangement or system it is contemplated maintaining equal volumes of platinum reforming catalyst in all three reactors and arranging the selective conversion zeolite catalyst as a downstream bed of catalyst in the third reactor and quenching the reformate product passed from the second reactor before entering the third reactor. This scheme has the obvious disadvantage of cooling not only the selective conversion catalyst but also the platinum catalyst in the third reactor and such cooling reduces the availability of the platinum catalyst to function properly in the third reactor. In this arrangement the platinum catalyst in reactors 1 and 2 has to operate at a much higher severity and reduce recycle gas ratio in order to approach a desired final octane. Such an operation is obviously undesirable. In yet another arrangement it is proposed to place the large third reactor in the sequential processing position of the second reactor thereby sequentially increasing the availability of platinum reforming catalyst in the operation. In this arrangement the selective conversion catalyst would occupy the second reactor now arranged in the sequence to act as the third reactor. This system now permits the selective conversion catalyst and its operation to be independently controlled by selective temperatures as herein described. However, even though more platinum catalyst has been made available in the reforming train there is no way to reheat the reforming reactants between the catalyst beds of the large reactor containing the two volumes of platinum catalyst to provide the necessary endothermic heat of reaction therein. Consequently the third bed of platinum catalyst is forced to remain at the effluent temperature resulting from the endothermic reactions encountered in the second bed of platinum catalyst. Therefore the third bed of catalyst in the large reactor cannot be used effectively or efficiently.

The present invention is particularly directed to the new and improved method of arranging and incorporating a selective crystalline aluminosilicate conversion catalyst of the ZSM-5 type or an erionite type of zeolite in an existing three reactor reforming system comprising a larger third reactor. This new system and method of operation includes the provision for quenching reformate product passed from an ultimate bed of platinum reforming catalyst housed in the third reactor before it contacts the downstream zeolite type selective conversion catalyst when it is desired to exclude this selective conversion catalyst from the reaction train. On the other hand, when the selective conversion catalyst is to be included in the reaction or hydrocarbon conversion train, quenching of the reformate may be accomplished only to that extent required to achieve a desired reformate temperature within the range of 600° to about 850° F. as herein defined before contact thereof with the selective conversion catalyst.

The new method and system of the present invention minimizes construction changes required in an existing reforming system, permits the optimum use of a platinum reforming catalyst in all reactors and the use of particularly selective zeolite conversion catalyst under particular temperature conditions as a function of product demand. The improved catalyst system of this invention permits swinging the reactions desired to optimize the yields of $C_3$/gasoline yields in winter/summer operations and make the most effective use of the existing large third stage reforming reactor.

In accordance with this invention the third or last reactor of a multi-reactor reforming operation is equipped with means such as screens, foraminous members or other means between which the separate bed of catalyst are retained and means intermediate thereto containing inert distributing solids comprising alumina, aluminum balls etc., wherein the quench fluid is injected. Thus reformate product of the platinum catalyst system may or may not be quenched before contact with the downstream bed of selective conversion catalyst. In this arrangement cool hydrogen rich recycle gas is relied upon as quench medium in combination with the platinum catalyst operating endothermic heat loss to cool the reformate effluent thereof to a temperature below 850° F. or to an optimum temperature level for substantially inactivating the selective conversion catalyst. On the other hand, higher temperatures up to 1000° F. and temperatures commensurate with the higher reforming temperatures may also be employed to enjoy the high temperature reaction characteristics of, for example, a ZSM-5 catalyst. The arrangement of this invention particularly provides the versatility to swing the reforming operation to various winter/summer product demands or gasoline demand operations. Increasing the cool hydrogen recycle gas quench to produce a 600° F. reformate effluent temperature downstream of the ultimate platinum reforming catalyst bed will substantially completely quench the selective conversion zeolite catalyst activity to a negligible level and this permits maintaining a maximum platinum catalyst activity for gasoline yields. Reducing the quench to provide temperatures above 600° F. and about 700° F. on the other hand, balances the conversion selectivity of the ZSM-5 conversion catalyst system. Further reducing the quench to produce reformate temperatures up to 800° F. will increase the selective ZSM-5 conversion catalyst activity and this can be used to counteract catalyst aging effects during production of (LPG) liquid propane gas. Eliminating the quench altogether can permit the selective conversion catalyst to operate at an upper temperature level above 850° F. and up to about 900° F. or as high as 1000° F. for maximum conversion of reformate components. It is clear from the above that the method and system herein described provides a novel scheme and method for operating a dual catalyst system with catalysts of significantly different reaction selective characteristics at their respective optimum activity levels. Furthermore, the method and system herein described permits the above identified benefits to be practiced in existing facilities with a minimum of equipment changes and investment costs.

BRIEF DESCRIPTION OF THE DRAWING

The drawing is a schematic arrangement of a multi-reactor platinum catalyst reforming operation modified to include quench facilities in the third reactor stage thus permitting the operating conversions of the invention.

DISCUSSION OF SPECIFIC EMBODIMENTS

Referring now to the drawing, by way of example, a naphtha boiling hydrocarbon feed is introduced to a multi-reactor reforming operation by conduit 2. Normally the naphtha feed will have been subjected to hydrogenation conditions to remove sulfur and nitrogen before contact with a platinum reforming catalyst. The naphtha charge most usually comprises $C_5$ or $C_6$ and higher boiling hydrocarbons boiling up to about 400° F. is combined with a hydrogen rich recycle gas introduced by conduit 4. The combined naphtha-hydrogen stream is then passed through preheat furnace 6 wherein the temperature of the naphtha-hydrogen mixture is raised to at least about 850° F. The preheated naphtha-hydrogen charge is then passed by conduit 8 to reactor 10 containing a bed of platinum type reforming catalyst $R_1$. Catalyst bed $R_1$ is the first in a sequence of reforming catalyst beds comprising three separate beds of platinum catalyst which may be of equal or different volume catalyst beds maintained under temperature, pressure space velocity and hydrogen pressure conditions provided for effecting dehydrogenation, cyclization, isomerization and hydrocracking of components in the naphtha charge to form branched and ring compounds of a higher octane rating. The reactions promoted by platinum reforming catalyst including the various bimetallic reforming catalyst operations are discussed at considerable length in the prior art. Patents particularly related to the more recently developed bimetallic reforming operations include U.S. Pat. No. 3,659,524 Derr Jr., et al and U.S. Pat. No. 3,474,026 Derr Jr., et al.

In the arrangement of the figure, naphthene dehydrogenation effected in the presence of catalyst $R_1$ produces a significant endothermic heat loss. Thus the effluent of reactor 10 is passed by conduit 12 to furnace 14 wherein the effluent is reheated to an elevated temperature of at least 850° F. before passage over the second platinum catalyst bed $R_2$. In bed $R_2$, further dehydrogenation is accomplished along with cyclization and isomerization along with cyclization and isomerization reaction which also produce a heat loss. The effluent of catalyst bed $R_2$ is then passed by conduit 20 to furnace 22 for reheating thereof to re-establish the temperature of the effluent thus formed for further processing over a third bed of platinum reforming catalyst $R_3$ at a temperature above 850° F. Thus in furnace 22, the reformate is reheated to a temperature of at least 850° F. before passage by conduit 24 and contact with platinum catalyst $R_3$.

The reformate material or effluent flowing from the final platinum catalyst bed $R_3$ at a temperature usually in excess of about 850° F. may then be handled as discussed hereinbefore. That is, the reformate from platinum catalyst bed $R_3$ may pass directly in contact with catalyst bed $R_4$ comprising a crystalline zeolite type of selective conversion catalyst defined above without altering the temperature of the reformate to promote the production of LPG materials or the reformate may be quenched with cold hydrogen rich recycle gas to reduce the temperature of the reformate as desired to meet the conversion temperature characteristics of the $R_4$ zeolite catalyst. In the arrangement of the figure, the effluent from reactor 26 is passed by conduit 28 through cooler 32 and then to a high pressure separator 30 wherein a separation is made between hydrogen rich recycle gases and higher boiling reformate product. Hydrogen rich recycle gas is withdrawn from separator 30 by conduit 34 containing compressor 36. A portion of the gas is recycled as by conduit 4 for use as above described in the reforming operation. Another portion of the hydrogen rich recycle gas is passed by conduit 37 containing flow control valve 38 to distributor 39. The cool hydrogen rich quench gas passed by conduit 37 to a distributor means 39 positioned between catalyst beds $R_3$ and $R_4$. The distributor means 39 may be any device which will provide intimate contact between the recycled cool quench gas and reformate product to obtain a desired quench thereof when needed.

The product effluent of the above operation from which hydrogen rich recycle gas is removed is then passed by conduit 40 to a stabilizer vessel 42. In some systems it may be desirable to use a low pressure separator following the higher pressure separator 30 or a depropanizer and a debutanizer vessel may be used ahead of the stabilizer vessel. On the other hand, the stabilizer vessel 42 may be operated to recover $C_4$ and lower boiling hydrocarbons from an upper portion thereof with higher boiling material comprising $C_5$+ hydrocarbons being withdrawn from the bottom of the vessel as by conduit 44. The overhead is withdrawn from the stabilizer vessel by conduit 46, cooled in cooler 48 sufficient to condense $C_4$ and heavier material which is then passed to an accumulator drum 52 by conduit 50. $C_3$ and lower boiling hydrocarbons are withdrawn from the accumulator by conduit 54. $C_4$ and higher boiling hydrocarbon material is passed from drum 52 to the tower as reflux by conduit 56. Hydrocarbon material not recycled as reflux is withdrawn by conduit 58.

The concepts of this invention defined hereinbefore are supported by the following examples comprising tables of data for the respective operations defined.

EXAMPLE 1

A selective conversion catalyst comprising erionite was employed in the final catalyst bed of the enlarged third reactor of a three reactor reforming operation. In this example the selective conversion catalyst was quenched with hydrogen recycle gas in an amount sufficient to obtain a 92.0 octane number clear gasoline product of reforming. Reforming severity was reduced.

Table 1

| | | | |
|---|---|---|---|
| Catalyst Arrangement | | Pt/Pt/Pt - SC zeolite | |
| Reformer LHSV | | 1.5 | |
| SC Zeolite LHSV[1] | | 2.50 | |
| Reformer Recycle Ratio (Total)[2] | | 8.0 | |
| Average $H_2$ Recycle Ratio[2](Pt) | | 5.8 ($H_2$ purity 72.2%) | |
| Quench - Moles[2] | | 3.3 | |
| Quench - Tem. ° F. | | 815 | |
| Interface (Pt R) Octane $C_5$+(R+O) | | 85.7 | |
| Outlet Octane, $C_5$+ (R+O) | | 91.9 | |
| N—$C_6$ Conv. % | | 85 | |
| MID CYCLE YIELDS | | | |
| | Wt.% | | |
| $H_2$ | 1.5 | 762 SCF/BBL | |
| $C_1$ | 1.5 | | |
| $C_2$ | 2.5 | Vol.% | |
| $C_3$ | 9.5 | 13.8 | |
| i-$C_4$ | 1.2 | 1.6 | |
| n-$C_4$ | 1.8 | 2.2 | |
| i-$C_5$ | 2.4 | 2.9 | |
| n-$C_5$ | 0.5 | 0.6 | 77.3% |
| $C_6$+ | 79.1 | 73.8 | |
| | 100.0 | 94.9 | |

[1]Based on reformer charge
[2]Per mol of reformer charge

EXAMPLE 2

The catalyst system of this example was the same as used in Example 1. During operation the reformer severity was reduced. No quenching of the selective conversion catalyst was practiced. The combination process was operated for 85% conversion to produce a 92.0 O.N. clear $C_6$+ gasoline product.

Table 2

| | | | |
|---|---|---|---|
| Catalyst Arrangement | | Pt/Pt/Pt - SC zeolite | |
| Reformer LHSV | | 1.5 | |
| SC (zeolite) LHSV [1] | | 1.84 | |
| Reformer Recycle Ratio (Total)[2] | | 11.3 | |
| Average $H_2$ Recycle Ratio[2] (Pt) | | 7.2 ($H_2$ purity 63.8%) | |
| Quench - Moles[2] | | 0 | |
| Quench - Temp. ° F. | | 953 | |
| Interface (PtR) Octane $C_5$+(R+O) | | 85.5 | |
| Outlet Octane, $C_5$+ (R+O) | | 92.0 | |
| n-$C_6$ Conversion | | 85% | |
| MID CYCLE YIELDS | | | |
| | Wt.% | | |
| $H_2$ | 1.4 | 688 SCF/BBL | |
| $C_1$ | 2.9 | | |
| $C_2$ | 3.8 | Vol.% | |
| $C_3$ | 8.1 | 11.8 | |
| i-$C_4$ | 1.2 | 1.5 | |
| n-$C_4$ | 1.4 | 1.7 | |
| i-$C_5$ | 2.3 | 2.7 | |
| n-$C_5$ | 0.3 | 0.4 | 76.5 |
| $C_6$+ | 78.6 | 73.4 | |
| | 100.0 | 91.5 | |

[1] Based on reformer charge.
[2] Per mol of reformer charge.

EXAMPLE 3

The catalyst system of this example was the same as used in Example 1. The reforming operation was restricted to produce 92.0 O.N. clear (R+O). A maximum quench of the selective catalyst was practiced so that it was inactive.

Table 3

| | | | |
|---|---|---|---|
| Catalyst Arrangement | | Pt/Pt/Pt - SC (zeolite) | |
| Reformer LHSV | | 1.5 | |
| SC(zeolite)LHSV | | 2.5 | |
| Reformer Recycle Ratio (Total)[2] | | 4.5 | |
| Average Hydrogen recycle ratio[2]Pt | | 3.6 (80.0% $H_2$ purity) | |
| Quench - Moles[2] | | 6.8 | |
| Quench - Temp. ° F. | | 650 | |
| Interface (PtR) Octane (R+O) | | 92.1 | |
| Outlet Octane, $C_5$+ (R+O) | | 92.1 | |
| n-$C_6$ conversion | | NIL | |
| MID CYCLE YIELDS | | | |
| | Wt.% | | |
| $H_2$ | 2.0 | 965 SCF/BBL | |
| $C_1$ | 1.4 | | |
| $C_2$ | 2.4 | Vol.% | |
| $C_3$ | 3.6 | 5.2 | |
| i-$C_4$ | 1.7 | 2.2 | |
| n-$C_4$ | 2.5 | 3.2 | |
| i-$C_5$ | 3.5 | 4.1 | |
| n-$C_5$ | 2.1 | 2.4 | 81.8 |
| $C_6$+ | 80.8 | 75.3 | |
| | 100.0 | 92.4 | |

It will be observed upon comparing the data of the above examples that Example 3 using maximum quench produced a higher purity hydrogen stream, and a greater volume percent of $C_5$+product yield of 92.0 octane rating clear than either Examples 1 or 2. Thus, reducing the temperature of the platinum catalyst reformate product to about 650° F. substantially inactivated the selective conversion catalyst. On the other hand, when a selective quench operation was practiced as shown in Example 1, greater yields of $C_3$ hydrocarbons was experienced than in either Examples 2 and 3. Following the operation of Example 2, provided low purity hydrogen recycle gas, when no quench was employed. Also it is to be noted that optimum yield of $C_3$ hydrocarbons also was not made under the no quench conditions of Example 2. Thus it is observed from Table 1, Example 1, that a selective quenching operation works to advantage in the production of LPG ($C_3$ hydrocarbons) and such an operation also improves the hydrogen purity of the recycle gas. Other advantages in the operation represented by Examples 1 to 3 will be readily apparent to those skilled in the art.

Having thus provided a general discussion of the invention and provided examples in support thereof, no undue restrictions are to be imposed by reasons thereof except as defined by the following claims.

I claim:

1. In a processing combination comprising a bed of crystalline zeolite conversion catalyst downstream of a plurality of separate sequentially arranged beds of naphtha reforming catalyst, the method for altering the product distribution obtained from the combination processing naphtha boiling material in the presence of hydrogen rich gas which comprises:

promoting the formation of gasoline boiling range material of higher octane rating than the naphtha charged to the combination process by operating the catalytic reforming portion under reduced recycled hydrogen partial pressure to promote dehydrogenation and the formation of gasoline boiling products in combination with relying upon a major portion of recycle hydrogen rich gas as quench fluid to reduce the temperature of the effluent obtained from catalytic reforming below about 650° F. before contacting the zeolite conversion catalyst and promoting the formation of LPG and aromatic rich concentrates with the catalytic combination by raising the hydrogen partial pressure of the catalytic reforming operation with hydrogen rich recycle gas sufficient to promote hydrocracking during reforming in combination with reducing the hydrogen gas quench fluid to raise the temperature of the effluent of reforming to at least 650° F.

2. The method of claim 1 wherein quenching of the reforming effluent is restricted to maintain a temperature within the range of 650° F. to about 850° F. during contact with the zeolite catalyst.

3. The method of claim 1 wherein a multi-metallic reforming catalyst is employed in the catalytic reforming operation at a temperature selected from within the range of 800° F. to 1000° F. at a pressure below 700 psig.

4. The method of claim 1 wherein the distribution of hydrogen rich gas recycled to the catalytic reforming operation and as quench fluid is adjusted to reduce the aging rate of the crystalline zeolite catalyst to an interval commensurate with the aging rate of the reforming catalyst.

5. The method of claim 1 wherein the crystalline zeolite conversion catalyst may be one of the group of selective relatively small pore crystalline zeolites identifiable with erionite type zeolites and the family of ZSM-5 crystalline zeolites.

6. The method of claim 1 wherein the selective zeolite conversion catalyst is maintained at a temperature within the range of 700° F. to 800° F. by recycle hydrogen rich quench gas in admixture with the effluent obtained from a platinum reforming catalyst operation.

7. The method of claim 1 wherein the crystalline zeolite catalyst material is maintained as a separate bed of catalyst in the last reforming zone of a plurality of sequentially arranged catalytic reforming zones and downstream of a bed of reforming catalyst in said last reforming zone.

8. The method of claim 1 wherein the crystalline zeolite is a ZSM-5 crystalline zeolite and the reforming catalyst contains platinum.

9. The method of claim 1 wherein the amount of adjustment of the reforming effluent quench and hydrogen to hydrocarbon ratio maintained during catalytic reforming of naphtha is determined as a function of the yield of desired LPG product.

* * * * *